US006354020B1

(12) United States Patent
Kimball et al.

(10) Patent No.: US 6,354,020 B1
(45) Date of Patent: Mar. 12, 2002

(54) SUPPORT AND CUSHIONING SYSTEM FOR AN ARTICLE OF FOOTWEAR

(75) Inventors: Neal F. X. Kimball, Framingham; Andrew A. Bjornson, Watertown; J. Spencer White, N. Easton; Alexander W. Jessiman, Scituate, all of MA (US)

(73) Assignee: Reebok International Ltd., Canton, MA (US)

( * ) Notice: Subject to any disclaimer, the term of this patent is extended or adjusted under 35 U.S.C. 154(b) by 0 days.

(21) Appl. No.: 09/403,306

(22) PCT Filed: Sep. 16, 1999

(86) PCT No.: PCT/US99/20951

§ 371 Date: Oct. 20, 1999

§ 102(e) Date: Oct. 20, 1999

(87) PCT Pub. No.: WO01/19211

PCT Pub. Date: Mar. 22, 2001

(51) Int. Cl.[7] ..... A43B 13/20

(52) U.S. Cl. ..... 36/29; 36/35 B; 36/3 B; 36/135

(58) Field of Search ..... 36/29, 28, 71, 36/35 B, 93, 153, 3 B

(56) References Cited

U.S. PATENT DOCUMENTS

| | | | | |
|---|---|---|---|---|
| 1,069,001 A | | 7/1913 | Guy | |
| 1,193,608 A | | 8/1916 | Poulson | |
| 1,605,985 A | | 11/1926 | Rasmussen | |
| 2,080,499 A | | 5/1937 | Nathansohn | |
| 2,266,476 A | | 12/1941 | Riess | |
| 3,120,712 A | | 2/1964 | Menken | |
| 3,225,463 A | | 12/1965 | Burnham | |
| 3,469,576 A | | 9/1969 | Smith et al. | |
| 4,100,686 A | | 7/1978 | Sgarlato et al. | |
| 4,219,945 A | | 9/1980 | Rudy | |
| 4,297,797 A | * | 11/1981 | Meyers | 36/44 |
| 4,312,140 A | | 1/1982 | Reber | |
| 4,358,902 A | | 11/1982 | Cole et al. | |
| 4,446,634 A | | 5/1984 | Johnson et al. | |

(List continued on next page.)

FOREIGN PATENT DOCUMENTS

| | | |
|---|---|---|
| DE | 820869 | 11/1951 |
| DE | 2800-359 | 7/1979 |
| EP | 0714 613 | 6/1996 |
| FR | 720257 | 2/1932 |
| FR | 2614510 | 11/1988 |
| FR | 2663208 | 12/1991 |
| GB | 338266 | 12/1930 |
| GB | 2039717 | 8/1980 |
| GB | 2114425 | 8/1983 |
| WO | WO 91/16831 | 11/1991 |
| WO | WO 93/12685 | 7/1993 |
| WO | WO 93/14659 | 8/1993 |
| WO | WO 95/20332 | 8/1995 |
| WO | WO 98/09546 | 3/1998 |

*Primary Examiner*—Mickey Yu
*Assistant Examiner*—Jila M. Mohandesi
(74) *Attorney, Agent, or Firm*—Sterne, Kessler, Goldstein & Fox P.L.L.C.

(57) ABSTRACT

A support and cushioning system for an article of footwear. The system includes a resilient insert disposed between a midsole and an outsole of a shoe. The resilient insert includes several chambers disposed in a heel portion of the resilient insert. These chambers are fluidly interconnected to each other via heel chamber interconnection passages. The resilient insert also includes several chambers disposed in a forefoot portion of the resilient insert. These chambers are also fluidly interconnected to each other. A connecting passage connects at least one of the chambers in the heel portion and at least one of the chambers in the forefoot portion of the resilient insert. A bladder having a fluidly interconnected heel chamber and forefoot chamber is also inserted above the midsole to provided added cushioning to the wearer. In one embodiment, the resilient insert contains air at ambient pressure and the bladder contains air at slightly above ambient pressure.

34 Claims, 12 Drawing Sheets

U.S. PATENT DOCUMENTS 4,458,430 A 7/1984 Peterson
4,577,417 A 3/1986 Cole
4,763,426 A * 8/1988 Polus et al. ..... 36/29
4,779,359 A 10/1988 Famolare, Jr.
4,799,319 A 1/1989 Zellweger
4,845,861 A 7/1989 Moumdjian
4,856,208 A 8/1989 Zaccaro
4,936,030 A 6/1990 Rennex
4,999,931 A 3/1991 Vermeuen
5,025,575 A 6/1991 Lakic
5,131,174 A 7/1992 Drew et al.
RE34,102 E 10/1992 Cole et al.
5,179,792 A * 1/1993 Brantingham ..... 36/29
5,195,257 A 3/1993 Holcomb et al.
5,230,249 A 7/1993 Sasaki et al.
5,255,451 A 10/1993 Tong et al.
5,295,314 A 3/1994 Moumdjian
5,311,674 A 5/1994 Santiyanont et al.
5,313,717 A 5/1994 Allen et al.
5,335,382 A 8/1994 Huang
5,343,639 A 9/1994 Kilgore et al.
5,353,525 A 10/1994 Grim
5,375,346 A * 12/1994 Cole et al. ..... 36/29
5,406,719 A 4/1995 Potter
5,416,986 A 5/1995 Cole et al.
5,443,529 A 8/1995 Phillips
5,545,463 A 8/1996 Schmidt et al.
5,572,804 A 11/1996 Skaja et al.
5,625,964 A * 5/1997 Lyden et al. ..... 36/29
5,664,341 A 9/1997 Schmidt et al.
5,701,687 A 12/1997 Schmidt et al.
5,706,589 A 1/1998 Marc
5,741,568 A 4/1998 Rudy
5,755,001 A 5/1998 Potter et al.
5,771,606 A * 6/1998 Lichfield et al. ..... 36/29
5,794,361 A 8/1998 Sadler
5,802,739 A 9/1998 Potter et al.
5,832,630 A 11/1998 Potter
5,842,291 A 12/1998 Schmidt et al.
5,896,681 A * 4/1999 Lin ..... 36/28

* cited by examiner 1904
1902
1914
1602
1504
1522
1522
102
1512
1512
1506

1910
1908
1904
1906
1902
1914
1602
1504
102
1506
20
20

SUPPORT AND CUSHIONING SYSTEM FOR AN ARTICLE OF FOOTWEAR

BACKGROUND OF THE INVENTION

1. Field of the Invention

This invention relates generally to footwear, and more particularly to an article of footwear having a system for providing cushioning and support for the comfort of the wearer.

2. Related Art

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, during a typical walking or running stride, the achilles tendon and the arch stretch and contract, storing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain.

Proper footwear should complement the natural functionality of the foot, in part by incorporating a sole (typically, an outsole, midsole and insole) which absorbs shocks. However, the sole should also possess enough resiliency to prevent the sole from being "mushy" or "collapsing," thereby unduly draining the energy of the wearer.

In light of the above, numerous attempts have been made over the years to incorporate into a shoe means for providing improved cushioning and resiliency to the shoe. For example, attempts have been made to enhance the natural elasticity and energy return of the foot by providing shoes with soles which store energy during compression and return energy during expansion. These attempts have included using compounds such as ethylene vinyl acetate (EVA) or polyurethane (PU) to form midsoles. However, foams such as EVA tend to break down over time, thereby losing their resiliency.

Another concept practiced in the footwear industry to improve cushioning and energy return has been the use of fluid-filled devices within shoes. These devices attempt to enhance cushioning and energy return by utilizing cushions containing pressurized fluid that are disposed adjacent the heel and forefoot areas of a shoe. The overriding problem of these devices is that the cushioning means are inflated with a pressurized gas which is forced into the cushioning means, usually through a valve accessible from the exterior of the shoe.

There are several difficulties associated with using a pressurized fluid within a cushioning device. Most notably, it may be inconvenient and tedious to constantly adjust the pressure or introduce a fluid to the cushioning device. Moreover, it is difficult to provide a consistent pressure within the device thereby giving a consistent performance of the shoes. In addition, a cushioning device which is capable of holding pressurized gas is comparatively expensive to manufacture. Further, pressurized gas tends to escape from such a cushioning device, requiring the introduction of additional gas. Finally, a valve which is visible to the exterior of the shoe negatively affects the aesthetics of the shoe, and increases the probability of the valve being damaged when the shoe is worn.

A cushioning device which, when unloaded contains air at ambient pressure, provides several benefits over similar devices containing pressurized fluid. For example, generally a cushioning device which contains air at ambient pressure will not leak and lose air, because there is no pressure gradient in the resting state. The problem with many of these cushioning devices is that they are either too hard or too soft. A resilient member that is too hard may provide adequate support when exerting pressure on the member, such as when running. However, the resilient member will likely feel uncomfortable to the wearer when no force is exerted on the member, such as when standing. A resilient member that is too soft may feel comfortable to a wearer when no force is exerted on the member, such as when standing or during casual walking. However, the member will likely not provide the necessary support when force is exerted on the member, such as when running. Further, a resilient member that is too soft may actually drain energy from the wearer.

A shoe which incorporates a cushioning system including a means to provide resilient support to the wearer during fast walking and running, and to provide adequate cushioning to the wearer during standing and casual walking is disclosed in U.S. Pat. No. 5,771,606 to Litchfield et al., which is incorporated herein in its entirety by reference. U.S. Pat. No. 5,771,606 describes a resilient insert member including a plurality of heel chambers, a plurality of forefoot chambers and a central connecting passage fluidly interconnecting the chambers. The resilient insert is made from an elastomeric material and may contain air at ambient pressure. The resilient insert is placed between an outsole and a midsole of an article of footwear.

Although the resilient insert of U.S. Pat. No. 5,771,606 provides resilient support and adequate cushioning to the wearer during a wide range of activities, the arrangement and shape of the forefoot chambers results in a decrease in flexibility of the resilient insert about the metatarsal area of the foot. In addition, the shape, interconnection and placement of the heel chambers make the resilient insert somewhat rigid, such that substantial cushioning only occurs as to downward forces during heel strike.

Accordingly, what is needed is a shoe which incorporates a cushioning system including a means to provide resilient support and adequate cushioning to the wearer that anatomically compliments the wearer's foot so that flexibility is maintained and stability increased. In addition, the cushioning system must be more compliant during a wearer's gait thereby providing maximum support and cushioning benefit when downward and/or shear forces are applied.

SUMMARY OF THE INVENTION

To achieve the foregoing and other objects, and in accordance with the purposes of the present invention as embodied and broadly described herein, the article of footwear of the present invention comprises a sole and a resilient support and cushioning system. The system of the present invention includes a resilient insert member and a bladder disposed within an article of footwear.

In one embodiment, the resilient insert includes a plurality of heel chambers, a plurality of forefoot chambers and a central connecting passage fluidly interconnecting one of the heel chambers with one of the forefoot chambers. The forefoot chambers are staggered and fluidly interconnected in series along either side of forefoot chamber interconnection passages. Each forefoot chamber is arranged so that a line taken lengthwise through each chamber is essentially perpendicular to a longitudinal centerline of the resilient insert.

The single central connecting passage and arrangement of the forefoot chambers i.e., their length extending in a lateral rather than a longitudinal direction, allow for a relatively "free space" below the metatarsal area of the foot allowing for better flexibility. Further, the staggered arrangement of the forefoot chambers on either side of the centrally located forefoot chamber interconnection passages reduces the number of hard edges of the forefoot chamber under the metatarsal region of the foot thereby reducing the rigidity of the insert in that area while still maintaining its supportive function.

In one embodiment, the central connecting passage contains an impedance means to restrict the flow of air between the heel chambers and the forefoot chambers. During heel strike, the impedance means prevents air from rushing out of the heel chambers too quickly. Thus, the air in the heel chambers provides support and cushioning to the wearer's foot during heel strike.

The bladder of the present invention includes at least one heel chamber, at least one forefoot chamber and at least one connecting passage fluidly interconnecting the two chambers. In one embodiment, the bladder is disposed above the midsole of the article of footwear, and provides cushioning to the wearer's foot. In one embodiment, the bladder is vacuum formed from two sheets of resilient, non-permeable elastomeric material such that the bladder contains air at slightly above ambient pressure.

In use, the bladder provides cushioning to the wearer's foot while standing or during casual walking. The resilient insert provides added support and cushioning to the wearer's foot during fast walking and running. In an alternate embodiment, for example, for use as a high performance shoe, the article of footwear may contain only the resilient insert disposed in the sole. In another alternate embodiment, for example, for use as a casual shoe, the article of footwear may contain only the bladder disposed above the sole.

When stationary, the foot of a wearer is cushioned by the bladder. When the wearer begins a stride, the heel of the wearer's foot typically impacts the ground first. At this time, the weight of the wearer applies downward pressure on the heel portion of the resilient insert, causing the heel chambers to be forced downwardly. A large lateral heel chamber absorbs the main impact. In addition, the wearer's forward momentum at foot strike causes the heel of the foot to move forward briefly while a heel portion of the shoe sole is still in contact with the ground. This forward velocity creates a shear load which forces a decoupled portion of the large lateral heel chamber to flex forward with the weight of the wearer. As the foot of the wearer then rolls medially and forwardly, the forces on the heel chambers dissipate. With reference to the large lateral heel chamber, this results in the decoupled portion returning to its original unflexed position. The fore-aft flexing of the large lateral heel chamber acts as a shock absorber in the longitudinal direction of the insert due to the shearing action within the chamber that allows the foot to briefly "glide" forward and aft upon the resilient insert.

In this embodiment, the heel chambers are also fluidly interconnected in series in a U-shape along heel chamber interconnection passages. Each heel chamber has a functionally distinctive shape with the large lateral heel chamber having a decoupled portion capable of fore-aft flexing. The fore-aft flexing of the large lateral heel chamber creates a shearing action within that chamber which allows for cushioning of shear forces as well as cushioning of downward forces. The rearmost medial heel chamber also has a decoupled portion which acts to supply air to a forward triangular-shaped heel chamber on the medial side of the resilient insert. The triangular-shaped heel chamber traps air and acts as a medial post to help prevent over-pronation of the foot.

The heel chambers of the resilient insert are connected via heel chamber interconnection passages. A rearmost passage essentially divides the heel portion into a medial region and a lateral region so that the two regions act independently of each other. The medial region heel chambers are designed geometrically to help compensate for the problem of over-pronation, the natural tendency of the foot to roll inwardly after heel impact.

During a typical gait cycle, the main distribution of forces on the foot begins adjacent the lateral side of the heel during the "heel strike" phase of the gait, moves toward the center axis of the foot in the arch area at mid-stride, rolls medially and then moves to the medial side of the forefoot area during "toe-off."

The configuration of the heel chamber interconnection passage between the rearmost medial heel chamber and the triangular-shaped medial heel chamber ensures that the air flow within the resilient insert complements such a gait cycle. Thus, the downward pressure resulting from heel strike causes air within the resilient insert to flow from the lateral region into the medial region, increasing air pressure therein. The medial region stiffens due to the increased air pressure, thereby providing support to the medial region of the wearer's foot and inhibiting over-pronation. Compression of the heel portion also causes the air in the lateral region to be forced forwardly, through the central connecting passage and into the forefoot portion of the resilient insert.

In addition, the forefoot and heel chambers of the resilient insert have substantially concave upper surfaces which extend beyond each side of the wearer's foot and act to cradle the foot upon impact thereby improving stability. The resilient insert is preferably blow molded from an elastomeric material, and may contain air at ambient pressure or slightly above ambient pressure. The resilient insert is disposed in the sole of an article of footwear.

The flow of air into the forefoot portion causes the forefoot chambers to expand, which slightly raises the forefoot or metatarsal area of the foot. When the forefoot of the wearer is placed upon the ground, the expanded forefoot chambers help cushion the corresponding impact forces. As the weight of the wearer is applied to the forefoot, the downward pressure caused by the impact forces causes portions of the forefoot chambers to compress while their concave upper surfaces inflate to cradle the foot and increase stability. Simultaneously, air is thrust rearwardly through the central connecting passage into the heel portion.

After "toe-off," no downward pressure is being applied to the article of footwear, so the air within the resilient insert should return to its normal state. Upon the next heel strike, the process is repeated.

In light of the foregoing, it will be understood that the system of the present invention provides a variable, non-static cushioning, in that the flow of air within the bladder and the resilient insert complements the natural biodynamics of an individual's gait.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other devices and applications.

Figure 1:
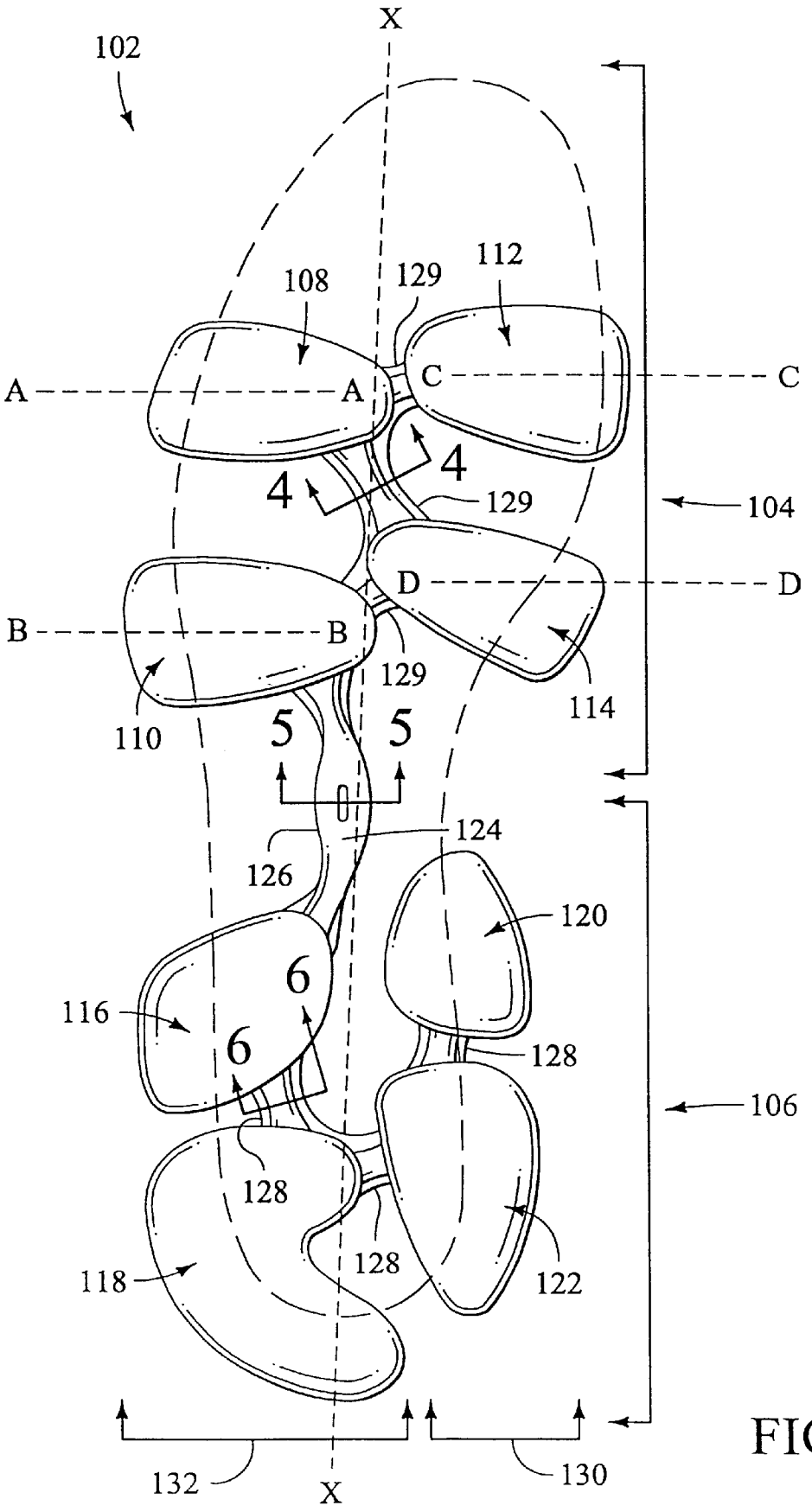
FIG. 1 is a top plan view of a resilient insert in accordance with the present invention.
Figure 2:
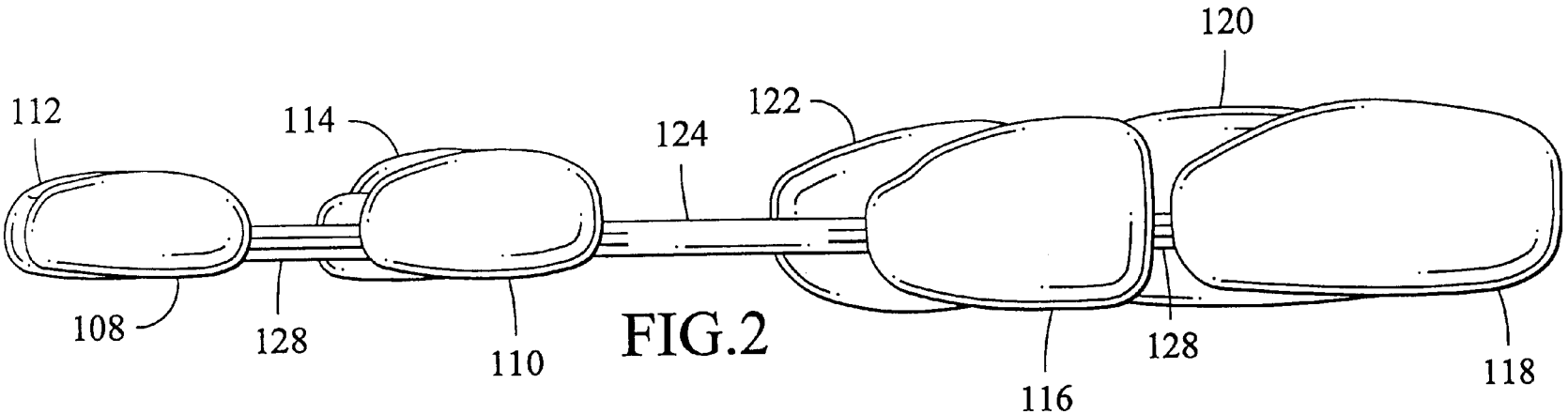
FIG. 2 is a lateral side view of the resilient insert of FIG. 1.
Figure 3:
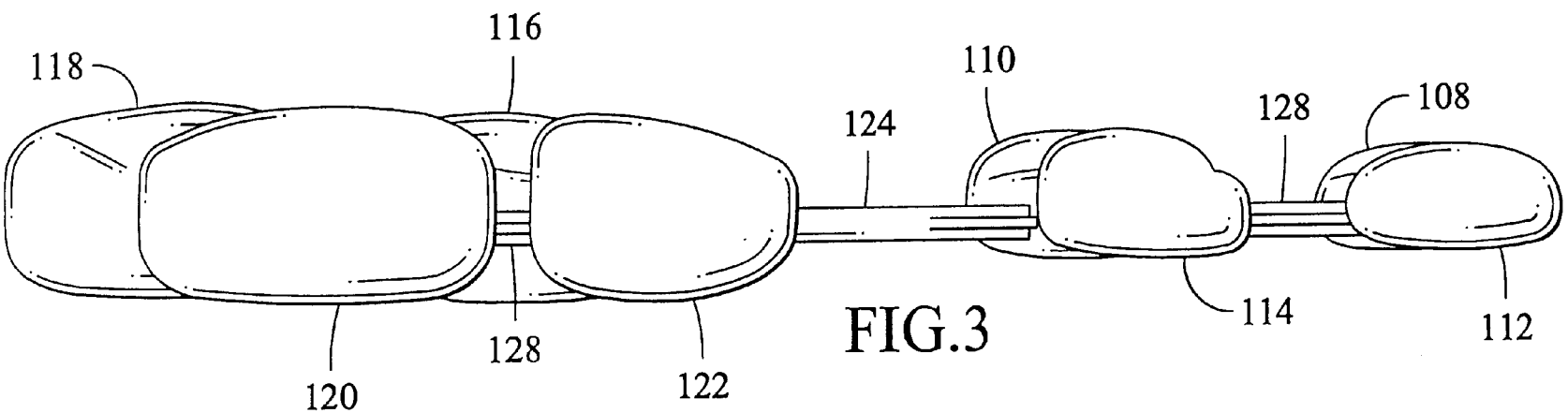
FIG. 3 is a medial side view of the resilient insert of FIG. 1.

Referring now to FIGS. 1–3, a resilient insert 102 is shown. Resilient insert 102 provides an article of footwear with continuously modifying cushioning and cradling of a wearer's foot, such that a wearer's stride forces air within resilient insert 102 to move in a complementary manner with respect to the stride.

FIG. 1 is a top plan view of resilient insert 102 in accordance with the present invention. FIG. 2 is a lateral side view of resilient insert 102. FIG. 3 is a medial side view of resilient insert 102.

Resilient insert 102 is a three-dimensional structure formed of a suitably resilient material so as to allow resilient insert 102 to compress and expand while resisting breakdown. Preferably, resilient insert 102 may be formed from a thermoplastic elastomer or athermoplastic olefin. Suitable materials used to form resilient insert 102 may include various ranges of the following physical properties:

| | Preferred Lower Limit | Preferred Upper Limit |
|---|---|---|
| Density (Specific Gravity in g/cm <3>) | 0.80 | 1.35 |
| Modulus £ 300% Elongation (psi) | 1,000 | 6,500 |
| Permanent Set £ 200%% Strain (%) | 0 | 55 |
| Compression Set 22 hr/23° C. | 0 | 45 |
| Hardness | | |
| Shore A | 70 | — |
| Shore B | 0 | 55 |
| Tear Strength (KN/m) | 60 | 600 |
| Permanent Set at Break (%) | 0 | 600 |

Many materials within the class of Thermoplastic Elastomers (TPEs) or Thermoplastic Olefins (TPOs) can be utilized to provide the above physical characteristics. Thermoplastic Vulcanates (such as SARLINK from PSM, SANTAPRENE from Monsanto and KRATON from Shell) are possible materials due to physical characteristics, processing and price. Further, Thermoplastic Urethanes (TPU's), including a TPU available from Dow Chemical Company under the tradename PELLETHANE (Stock No. 2355-95AE), a TPU available from B. F. Goodrich under the tradename ESTANE and a TPU available from BASF under the tradename ELASTOLLAN provide the physical characteristics described above. Additionally, resilient insert 102 can be formed from natural rubber compounds. However, these natural rubber compounds currently cannot be blow molded as described below.

The preferred method of manufacturing resilient insert 102 is via extrusion blow molding. It will be appreciated by those skilled in the art that the blow molding process is relatively simple and inexpensive. Further, each element of resilient insert 102 of the present invention is created during the same preferred molding process. This results in a unitary, "one-piece" resilient insert 102, wherein all the unique elements of resilient insert 102 discussed herein are accomplished using the same mold. Resilient insert 102 can be extrusion blow molded to create a unitary, "one-piece" component, by any one of the following extrusion blow molding techniques: needle or pin blow molding with subsequent sealing, air entrapped blow molding, pillow blow molding or frame blow molding. These blow molding techniques are well known to those skilled in the relevant art.

Alternatively, other types of blow molding, such as injection blow molding and stretch blow molding may be used to form resilient insert 102. Further, other manufacturing methods can be used to form resilient insert 102, such as thermoforming and sealing, vacuum forming and sealing or rfwelding/hfwelding the resilient insert leaving an aperture so that the resilient insert may be inflated with air.

Resilient insert 102 is a hollow structure preferably filled with ambient air. In one embodiment, resilient insert 102 is impermeable to air; i.e., hermetically sealed, such that it is not possible for the ambient air disposed therein to escape upon application of force to resilient insert 102. Naturally, diffusion may occur in and out of resilient insert 102. The unloaded pressure within resilient insert 102 is preferably equal to ambient pressure. Accordingly, resilient insert 102 retains its cushioning properties throughout the life of the article of footwear in which it is incorporated. If resilient insert 102 is formed by air entrapment extrusion blow molding, the air inside resilient insert 102 may be slightly higher than ambient pressure (e.g., between 1–5 psi above ambient pressure).

As can be seen with reference to FIG. 1, resilient insert 102 is preferably a unitary member comprising three distinct components: a forefoot portion 104, a heel portion 106, and a central connecting passage 124. Heel portion 106 is generally shaped to conform to the outline of the bottom of an individual's heel, and is disposed beneath and about the heel of a wearer when resilient insert 102 is incorporated within a shoe. In one embodiment, as shown in FIG. 1, heel portion 106 includes a plurality of heel chambers 116, 118, 120 and 122.

Disposed opposite heel portion 106 is forefoot portion 104. Forefoot portion 104 is generally shaped to conform to the forefoot or metatarsal area of a foot, and is disposed beneath and about a portion of the forefoot of a wearer when incorporated within a shoe. In one embodiment, as shown in FIG. 1, forefoot portion 104 includes a plurality of forefoot chambers 108, 110, 112 and 114. Preferably, the volume of air within the chambers of forefoot portion 104 is substantially less than the volume of air within the chambers of heel portion 106.

For a men's sample size nine, the measurements of the forefoot and heel chambers is as follows:

| Chamber Number & Location | Length (ins.) | Height (ins.) (outside edge) | Height (ins.) (inside edge) | Width (ins.) |
|---|---|---|---|---|
| Forefoot Chamber 108 (FIG. 7) | 2.073 | .630 | .394 | 1.158 |
| Forefoot Chamber 110 (FIG. 8) | 2.222 | .766 | .452 | 1.209 |
| Forefoot Chamber 112 (FIG. 9) | 1.993 | .630 | .394 | 1.217 |
| Forefoot Chamber 114 (FIG. 10) | 2.042 | .767 | .452 | 1.068 |
| Heel Chamber 116 (FIG. 11) | 1.679 | 1.140 | .906 | 1.467 |
| Heel Chamber 118 (FIG. 12) measurements on line 12A—12A | 1.986 | 1.179 | .900 | 2.359 |
| Heel Chamber 118 (FIG. 12) measurements on line 12B—12B | 1.495 | 1.072 | .768 | 2.359 |
| Heel Chamber 120 (FIG. 13) | 1.248 | 1.091 | .906 | 1.629 |
| Heel Chamber 122 (FIG. 14) | 1.324 | 1.182 | .904 | 2.178 |

The insert 102 measures 9.453 inches in total length and 4.521 inches in total width. The central connecting passage 124 varies in thickness from 0.197 inches in the forefoot to 0.236 inches in the heel. Further, forefoot chamber interconnection passages 129 are 0.197 inches thick whereas heel chamber interconnection passages 128 are 0.256 inches thick.

As shown in FIG. 1, impedance means 126 is disposed within central connecting passage 124. Impedance means 126 provides a restriction in central connecting passage 124 to restrict the flow of air through central connecting passage 124. In one embodiment, impedance means 126 comprises a convolution of connecting passage 124 formed by restriction walls 502 (shown in detail in FIG. 5) placed in central connecting passage 124. In FIG. 1, impedance means 126 is shown as being substantially oval-shaped. However, impedance means 126 may comprise numerous shapes or structures. For example, in another embodiment, the impedance means could be provided by a pinch-off of the material or increased wall thickness of the material.

Impedance means 126 prevents air from rushing out of heel chambers 116, 118, 120 and 122 upon heel strike wherein pressure is increased in heel portion 106. The shape or structure of impedance means 126 determines the amount of air that is permitted to pass through central connecting passage 124 at any given time.

The different structures of the impedance means of the present invention are accomplished during the preferred blow-molding manufacturing process described above. Accordingly, no complicated or expensive valve means need be attached to resilient insert 102. Rather, the shape of impedance means 126 is determined by the same mold used to form the remainder of resilient insert 102.

As noted above, the shape of impedance means 126 will affect the rate and character of air flow within resilient insert 102, in particular between heel portion 106 and forefoot portion 104 thereof.

Central connecting passage 124 comprises an elongated passage which connects heel portion 106 to forefoot portion 104. In the embodiment shown in FIG. 1, central connecting passage 124 connects a forefoot chamber 110 to a heel chamber 116.

Figure 4:
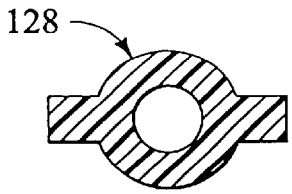
FIG. 4 is a cross-sectional view taken along line 4—4 of FIG. 1.
Figure 6:
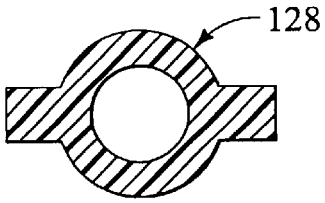
FIG. 6 is a cross-sectional view taken along line 6—6 of FIG. 6.

Heel chambers 116, 118, 120 and 122 are fluidly interconnected in series via heel chamber interconnection passages 128. Heel chamber interconnection passages 128 allow air to transfer between heel chambers 116, 118, 120 and 122. FIG. 6 shows a cross-sectional view of resilient insert 102 taken along line 6—6 through one of the heel chamber interconnection passages 128. The rearmost heel chamber interconnection passage 128 divides the heel portion into a medial region 130 and a lateral region 132. Similarly, forefoot chambers 108,110,112 and 114 are fluidly interconnected in series via forefoot chamber interconnection passages 129, as shown in FIG. 1. FIG. 4 shows a cross-sectional view of resilient insert 102 taken along a line 4—4, through one of the forefoot chamber interconnection passages 129. Forefoot chamber interconnection passages 129 allow air to transfer between staggered forefoot chambers 110, 114,108 and 112 respectively in forefoot portion 104.

As previously indicated, resilient insert 102 is formed of a suitably resilient material so as to enable heel and forefoot portions 106, 104 to compress and expand. Central connecting passage 124 is preferably formed of the same resilient material as the heel and forefoot portions 106, 104.

As shown in FIG. 2, heel chambers 116, 118, 120 and 122 are larger in volume, than forefoot chambers 108, 110, 112 and 114. This configuration provides heel chambers 116, 118, 120 and 122 with a larger volume of air for support and cushioning of the wearer's foot. Since typically during walking and running, the heel of the wearer receives a larger downward force during heel strike, than the forefoot receives during "toe-off", the extra volume of air in heel chambers 116, 118, 120 and 122 provides the added support and cushioning necessary for the comfort of the wearer. In particular, the large lateral heel chamber 118 is shaped and sized to absorb the main impact of the heel strike. Moreover, heel chamber 118 is shaped so as to flex forward as a result of the shear load created by the forward velocity of a wearer's foot at heel strike.

As can be seen with reference to FIG. 1, forefoot chambers 108, 110, 112 and 114 are staggered on either side of forefoot chamber interconnection passages 129. Further each forefoot chamber is arranged so that a line A—A, B—B, C—C and D—D taken lengthwise through respective forefoot chambers 108, 110, 112 and 114 is essentially perpendicular to a lateral centerline X—X of the resilient insert 102. The substantially longitudinal arrangement of the forefoot chambers as well as their staggered arrangement on either side of the forefoot chamber interconnection passages results in fewer hard edges of the forefoot portion of the insert being disposed directly under the metatarsal area of the foot. Due to the substantially "free space" directly under the metatarsal area of the wearer's foot, the insert has increased flexibility during toe-off and is more compliant to a wearer's gait.

Figure 5:
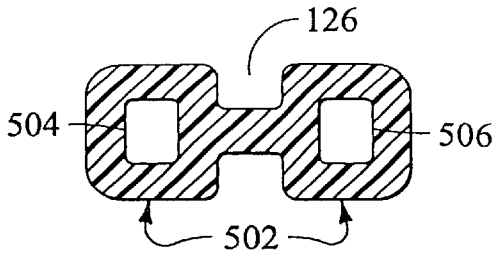
FIG. 5 is a cross-sectional view taken along line 5—5 of FIG. 1.

FIG. 5 is a cross-sectional view of resilient insert 102 taken along line 5—5 of FIG. 1, through the portion of central connecting passage 124 that contains impedance means 126. As shown, restriction walls 502 of impedance means 126 form barriers in central connecting passage 124. The sides of central connecting passage 124 and impedance means 126 combine to form narrow passages 504 and 506 on either side of impedance means 126. Narrow passages 504 and 506 slow the flow of air between heel portion 106 and forefoot portion 104 so that upon heel strike, the air in heel portion 106 gradually flows into forefoot portion 104 to provide adequate support and cushioning to the wearer's foot.

As shown in FIG. 1, once the air passes impedance means 126, it enters forefoot portion 104 via central connecting passage 124 by way of forefoot chamber 110. The air is then distributed via chamber interconnection passages 128 to forefoot chambers 114, 108 and 112, respectively. The staggered relationship of forefoot chambers 110, 114,108 and 112 on either side of forefoot chamber interconnection passages 129, as well as their length being laterally arranged, results in fewer edges of the resilient insert being directly under the metatarsal region of the wearer's foot. This results in greater flexibility in this area of the resilient insert which anatomically compliments the wearer's foot during toe-off.

Individual heel and forefoot chambers will now be discussed with reference to FIGS. 7–14.

Figure 7:
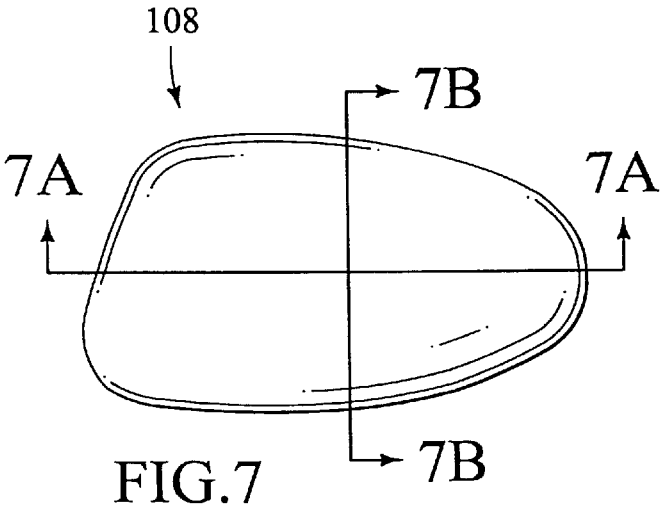
FIG. 7 is a top plan view of a foremost lateral forefoot chamber of FIG. 1.
Figure 7B:
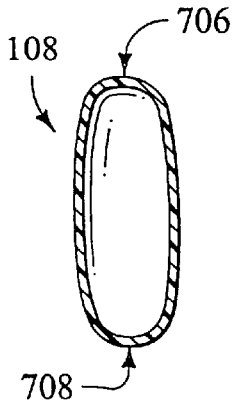
FIG. 7B is a cross-sectional view taken along line 7B—7B of FIG. 7.
Figure 7A:
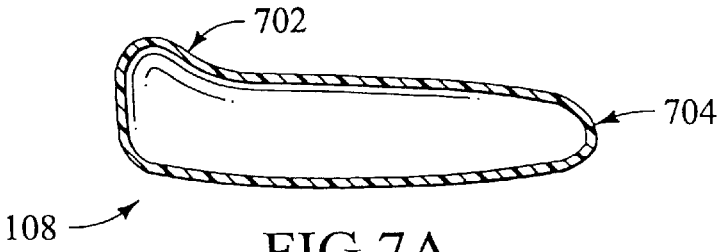
FIG. 7A is a cross-sectional view taken along line 7A—7A of FIG. 7.
Figure 8:
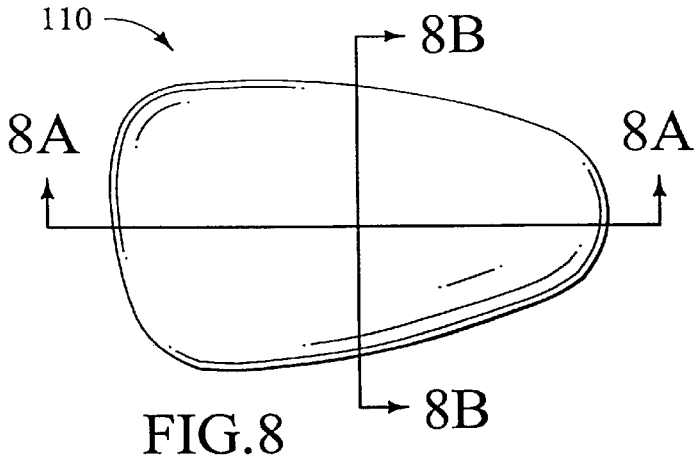
FIG. 8 is a top plan view of a rearward lateral forefoot chamber of FIG. 1.
Figure 8B:
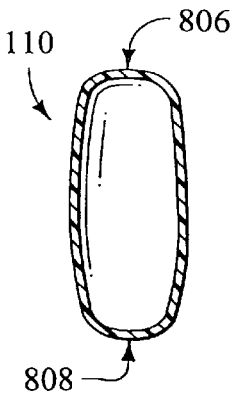
FIG. 8B is a cross-sectional view taken along line 8B—8B of FIG. 8.
Figure 8A:
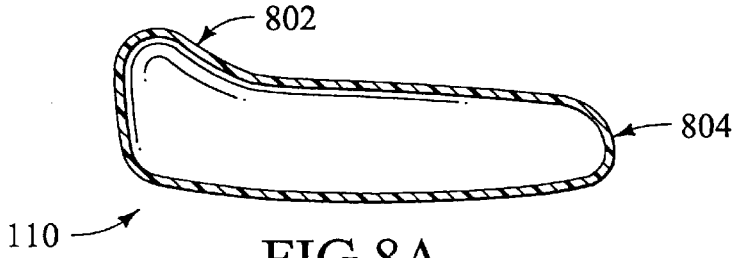
FIG. 8A is a cross-sectional view taken along line 8A—8A of FIG. 8.

FIGS. 7, 7A and 7B show forefoot chamber 108. As shown in FIG. 1, lateral forefoot chamber 108, is the foremost lateral chamber of resilient insert 102. Toward the outer edge of forefoot chamber 108, an upper surface 702 is concave and extends upwards beyond the outer edge of the wearer's foot, as shown in FIG. 7A. The concave upper surface 702 of lateral forefoot chamber 108 is not compressed during toe-off but instead inflates with air to cradle the foot of the wearer. Similarly, FIGS. 8, 8A and 8B show lateral forefoot chamber 110 which is the rearward lateral chamber of resilient insert 102, as shown in FIG. 1. Lateral forefoot chamber 110 also has a concave upper surface 802, as shown in FIG. 8A which extends upwards from the outer edge of forefoot chamber 110 and acts in the same manner during toe-off as lateral forefoot chamber 108.

Lateral forefoot chamber 108 has rounded edges 704, 706 and 708, as shown in FIGS. 7A and 7B. Rounded edges 704, 706 and 708 allow lateral forefoot chamber 108 to gradually collapse under pressure during toe-off so that air from forefoot portion 104 begins to flow toward central connecting passage 124 and heel portion 106. Similarly, lateral forefoot chamber 110 also has rounded edges 804,806 and 808, as shown in FIGS. 8A and 8B, to allow forefoot chamber 110 to gradually collapse under pressure during toe-off so that air from forefoot portion 104 begins to flow toward central connecting passage 124 and heel portion 106.

Figure 9:
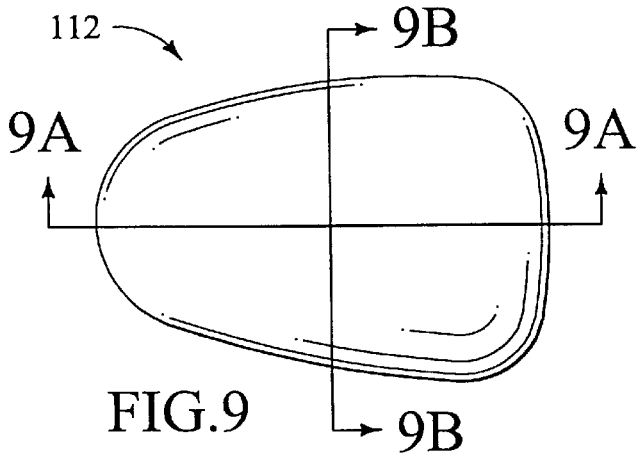
FIG. 9 is a top plan view of the foremost medial forefoot chamber of FIG. 1.
Figure 9B:
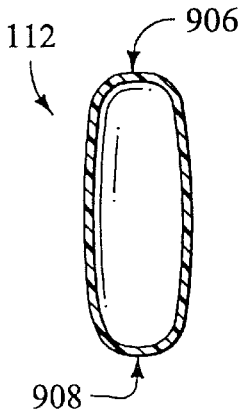
FIG. 9B is a cross-sectional view taken along line 9B—9B of FIG. 9.
Figure 9A:
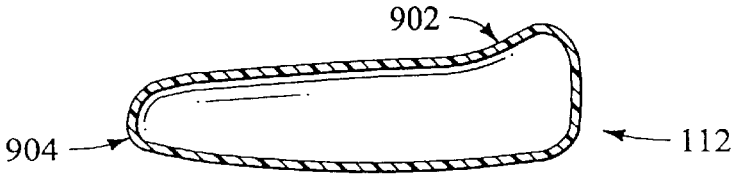
FIG. 9A is a cross-sectional view taken along line 9A—9A of FIG. 9.

FIGS. 9, 9A and 9B show medial forefoot chamber 112. As shown in FIG. 1, medial forefoot chamber 112 is the foremost medial forefoot chamber of resilient insert 102. Toward the outer edge of medial forefoot chamber 112, an upper surface 902 is concave and extends upwards beyond the inner edge of the wearer's foot, as shown in FIG. 9A.

Figure 10:
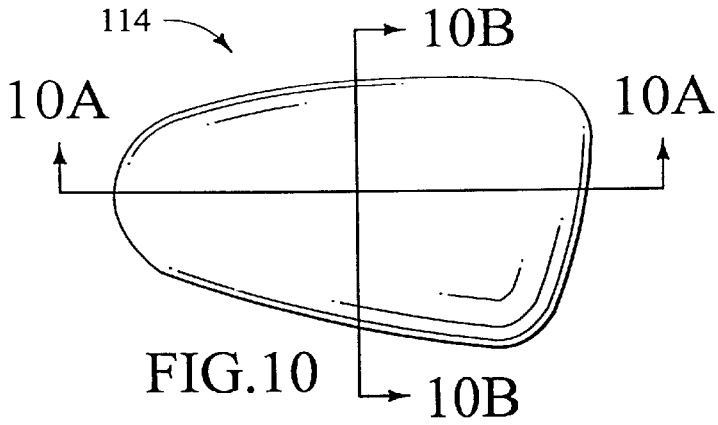
FIG. 10 is top plan view of a rearward medial forefoot chamber of FIG. 1.
Figure 10B:
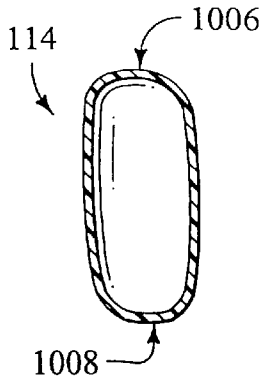
FIG. 10B is a cross-sectional view taken along line 10B—10B of FIG. 10.
Figure 10A:
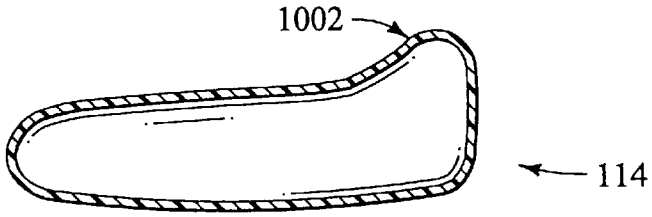
FIG. 10A is a cross-sectional view taken along line 10A—10A of FIG. 10.

The concave upper surface 902 of forefoot chamber 112 is not compressed during toe-off but instead inflates with air to cradle the foot of the wearer. Similarly, FIGS. 10, 10A and 10B show medial forefoot chamber 114 which is the rearward medial forefoot chamber of resilient insert 102, as shown in FIG. 1. Medial forefoot chamber 114 also has a concave upper surface 1002, as shown in FIG.10A which extend upwards from the outer edge of medial forefoot chamber 114 and acts in the same manner during toe-off as medial forefoot chamber 112.

Medial forefoot chamber 112 has rounded edges 904, 906 and 908, as shown in FIGS. 9A and 9B. Rounded edges 904, 906 and 908 allow medial forefoot chamber 112 to gradually collapse under pressure during toe-off so that air from forefoot portion 104 begins to flow toward central connecting passage 124 and heel portion 106. Similarly, medial forefoot chamber 114 also has rounded edges 1004, 1006 and 1008, as shown in FIGS. 10A and 10B, to allow medial forefoot chamber 114 to gradually collapse under pressure during toe-off so that air from forefoot portion 104 begins to flow toward central connecting passage 124 and heel portion 106.

Figure 11:
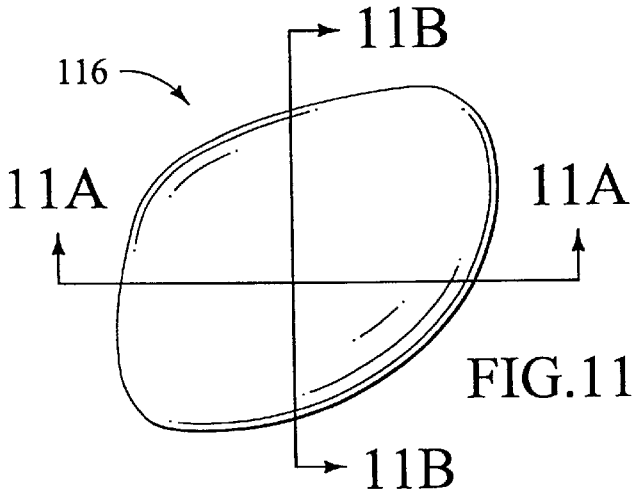
FIG. 11 is a top plan view of the foreward lateral heel chamber of FIG. 1.
Figure 11B:
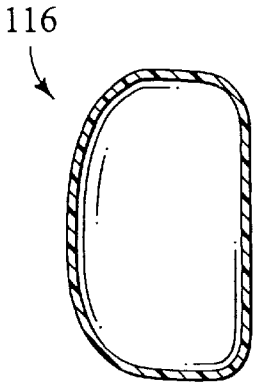
FIG. 11B is a cross-sectional view taken along line 11B—11B of FIG. 11.
Figure 11A:
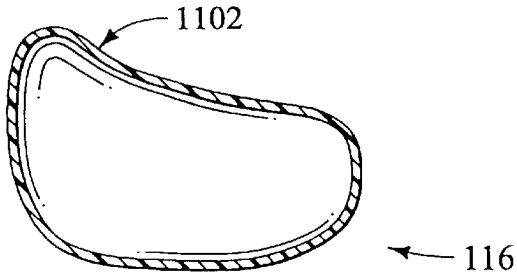
FIG. 11A is a cross-sectional view taken along line 11A—11A of FIG. 11.
Figure 12:
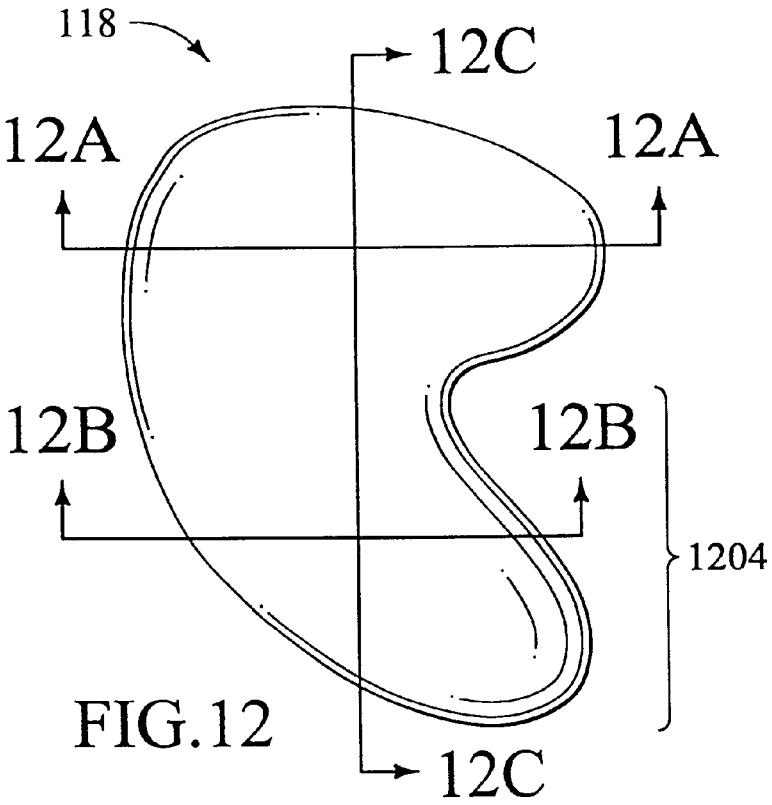
FIG. 12 is a top plan view of the rearmost lateral heel chamber of FIG. 1.
Figure 12C:
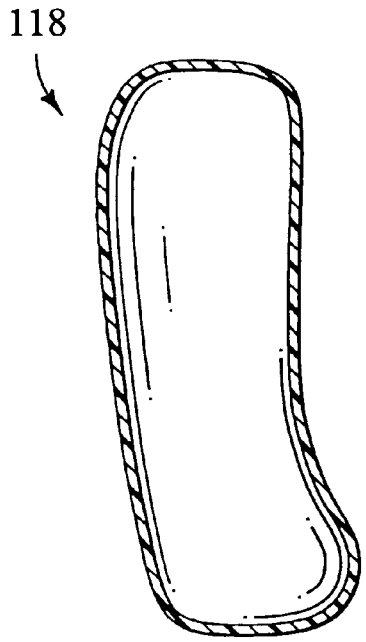
FIG. 12C is a cross-sectional view taken along line 12C—12C of FIG. 12.

FIGS. 11, 11A and 11B show lateral heel chamber 116. As shown in FIG.1, lateral heel chamber 116 is the forward lateral heel chamber of resilient insert 102. On the outer edge of lateral heel chamber 116, an upper surface 1102 is concave, as shown in FIG. 11A and extends upwards beyond the outer edge of the wearer's foot. The concave upper surface 1102 of lateral heel chamber 116 is not compressed during heel strike but instead inflates with air to cradle the foot of the wearer.

Figure 12A:
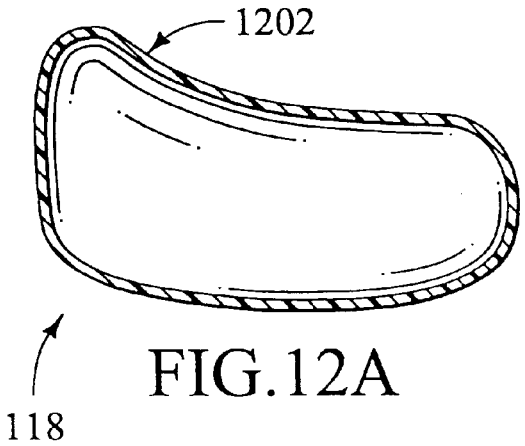
FIG. 12A is a cross-sectional view taken along line 12A—12A of FIG. 12.
Figure 12B:
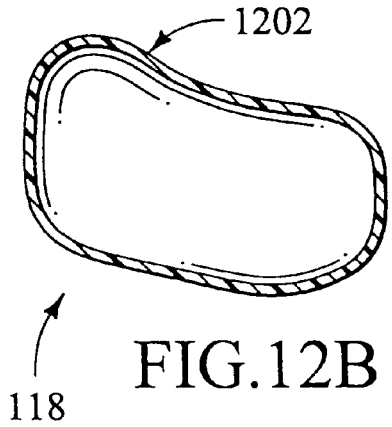
FIG. 12B is a cross-sectional view taken along line 12B—12B of FIG. 12.

Similarly, lateral heel chamber 118, as shown in FIGS. 12, 12A, 12B and 12C, is the rearmost lateral heel chamber of resilient insert 102. Lateral heel chamber 118 also has a concave upper surface 1202, as shown in FIG. 12A, which extends upwards from the outermost edge of heel chamber 118 and acts in the same manner during heel strike as lateral heel chamber 116. Heel chamber 118 also has a decoupled portion 1204 that extends rearward of heel chamber interconnection passage 128, as shown in FIG. 1. Decoupled portion 1204 absorbs the main impact of the heel strike thereby cushioning the wearer's heel from the downward force. The decoupled portion 1204 of heel chamber 118 also flexes forward due to the shear load created by the forward velocity of a wearer's foot at heel strike. As the foot of the wearer then rolls medially and forwardly, the forces on heel chambers 118 dissipate. This results in decoupled portion 1204 returning to its original "unflexed" position. The fore-aft flexing of decoupled portion 1204 of heel chamber 118 creates a shearing action within that chamber and acts as a shock absorber in the longitudinal direction X—X of insert 102. Thus, the wearer's foot will essentially "glide" back and forth upon the resilient insert due to the fore-aft flexing of decoupled portion 1204.

Figure 13:
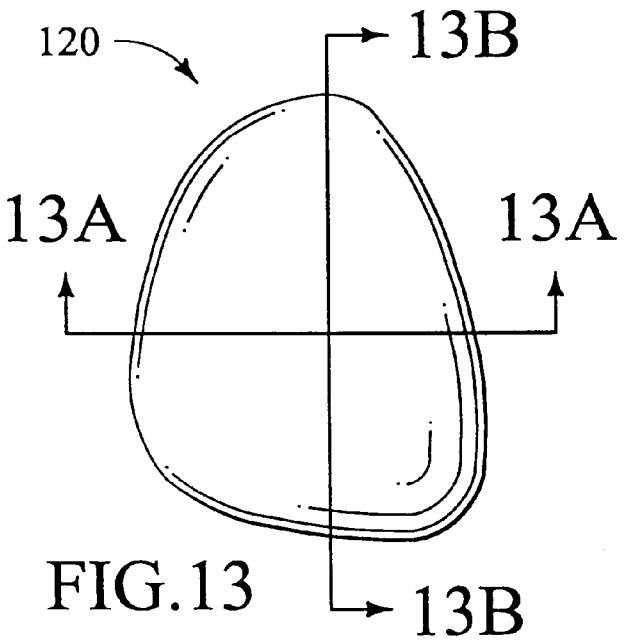
FIG. 13 is a top plan view of the foreward medial heel chamber of FIG. 1.
Figure 13B:
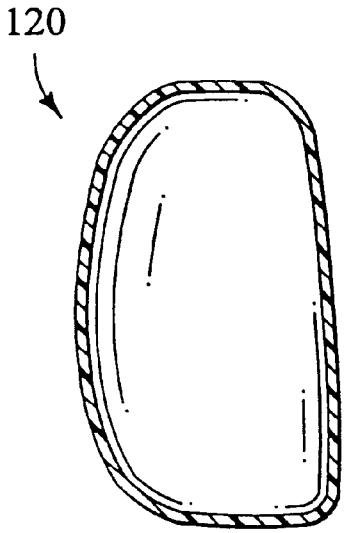
FIG. 13B is a cross-sectional view taken along line 13B—13B of FIG. 13.
Figure 13A:
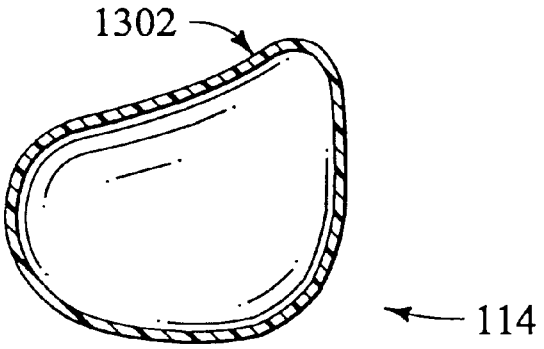
FIG. 13A is a cross-sectional view taken along line 13A—13A of FIG. 13.

FIGS. 13, 13A and 13B show medial heel chamber 120. As shown in FIG. 1, medial heel chamber 120 is the forward medial heel chamber of resilient insert 102. On the outer edge of medial heel chamber 120, an upper surface 1302 is concave, as shown in FIG. 13A and extends upwards beyond the medial edge of the wearer's foot. The concave upper surface 1302 of medial heel chamber 120 is not compressed during heel strike but instead inflates with air to cradle the foot of the wearer as well as to aid in preventing over-pronation of the wearer's foot.

Figure 14:
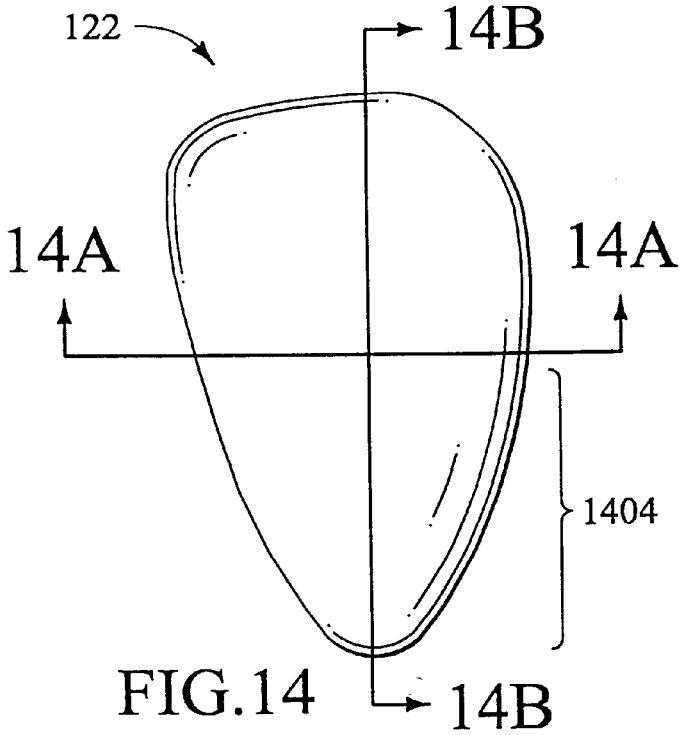
FIG. 14 is a top plan view of the rearmost medial heel chamber of FIG. 1.
Figure 14B:
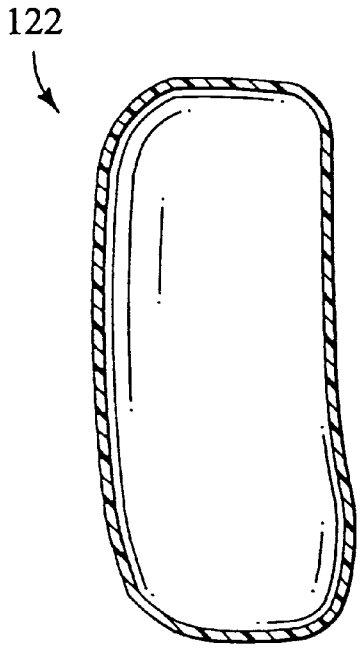
FIG. 14B is a cross-sectional view taken along line 14B—14B of FIG. 14.
Figure 14A:
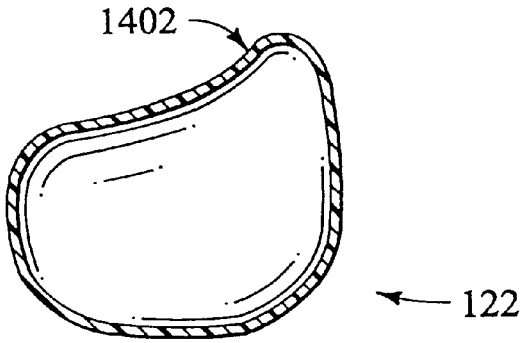
FIG. 14A is a cross-sectional view taken along line 14A—14A of FIG. 14.

Similarly, medial heel chamber 122, as shown in FIGS. 14, 14A and 14B, is the rearmost medial heel chamber of resilient insert 102. Medial heel chamber 122 also has a concave upper surface 1402, as shown in FIG. 14A, which extends upwards from the outer edge of heel chamber 122 and acts in the same manner during heel strike as medial heel chamber 120. Medial heel chamber 122 also has a decoupled portion 1404 that extends rearward from heel chamber interconnection passage 128, as shown in FIG. 1. Medial heel chamber 122 acts independently of lateral heel chamber 118 by providing air to medial heel chamber 120 during and just after heel strike.

Medial heel chambers 120 and 122 act together after heel strike to provide added support to the wearer's foot in medial region 130 to address the problem of over-pronation, the natural tendency of the foot to roll inwardly after heel impact. During a typical gait cycle, the main distribution of forces on the foot begins adjacent the lateral side of the heel during the "theel strike" phase of the gait, then moves toward the center axis of the foot in the arch area, and then moves to the medial side of the forefoot area during "toe-off." Heel chambers 120 and 122 on medial region 130 address the problem of over-pronation by preventing the wearer's foot from rolling to the medial side during toe-off by trapping air within the triangular shaped medial heel chamber 120. The outer medial edge of heel chamber 120 has a squared outer edge that provides extra stiffness so that the heel chamber is more rigid, and harder to compress along the outer edge thereof.

Figure 15:
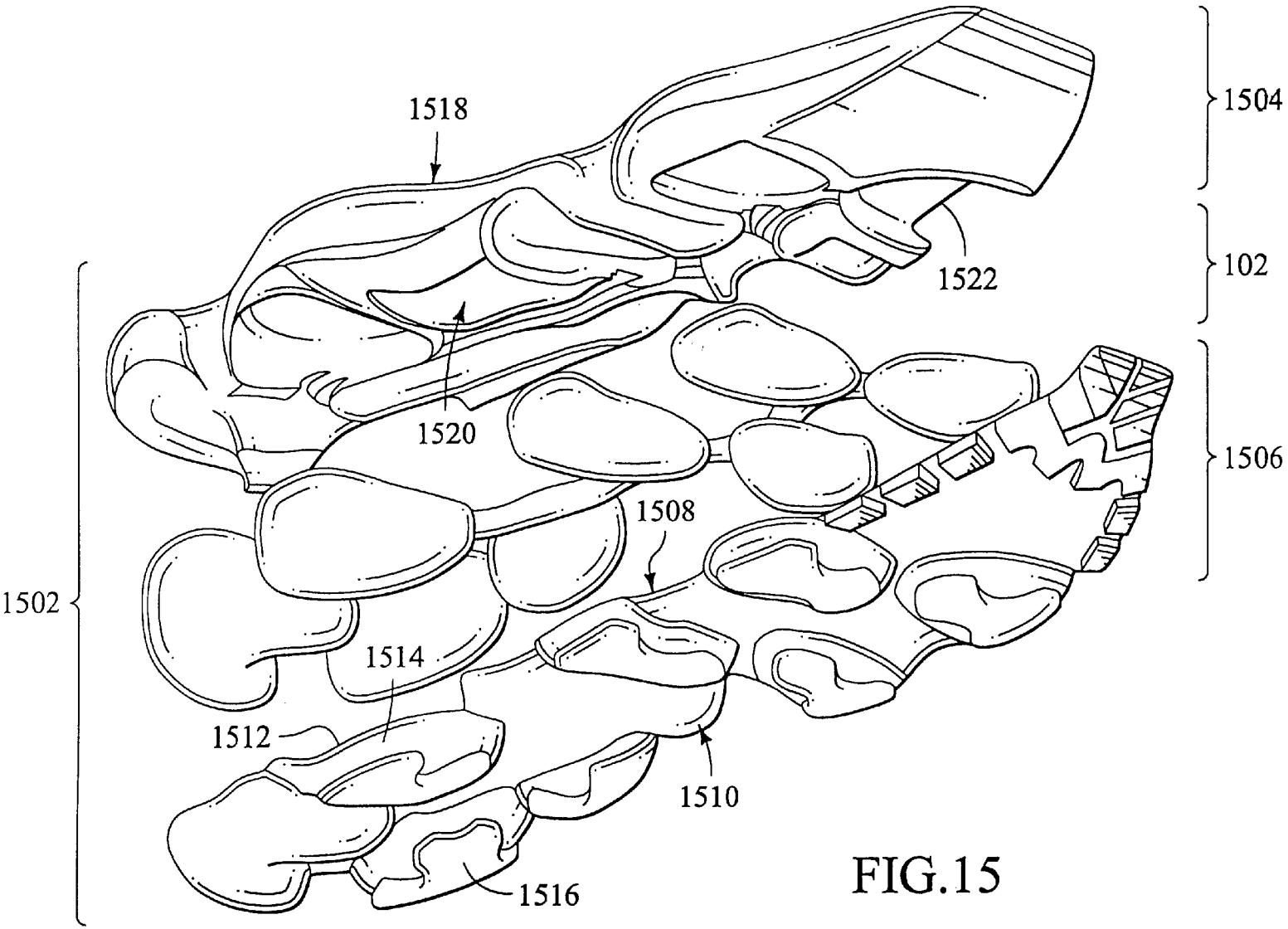
FIG. 15 is an exploded view of an exemplary configuration of an outsole, resilient insert and midsole in accordance with the present invention.

In order to appreciate the manner in which resilient insert 102 may be incorporated within an article of footwear, FIG. 15 discloses an exemplary configuration of incorporation. FIG. 15 is an exploded view showing resilient insert 102 disposed within a sole 1502. Sole 1502 includes an outsole 1506 and a midsole 1504. Thus, in the embodiment shown in FIG. 15, resilient insert 102 is shown disposed between outsole 1506 and midsole 1504. Outsole 1506 and midsole 1504 are described below with reference to FIG. 15.

Outsole 1506 has an upper surface 1508 and a lower surface 1510. Upper surface 1508 has concave indentations 1512 (not visible in FIG. 15) formed therein having upturned side edges 1514. Indentations 1512 are formed to receive resilient insert 102. Upturned side edges 1514 do not entirely cover the edges of resilient member 102 so that the exterior of resilient insert 102 is visible when it is disposed in sole 1502. Further, the rearmost chambers of resilient insert 102 are also visible. In one embodiment, outsole 1506 is made from a clear crystalline rubber material so that resilient insert 102 is visible to the wearer through outsole 1506. Outsole 1506 has tread members 1516 on lower surface 1510. Further, the bottom surface of concave indentations 1512 on lower surface 1510 of outsole 1506 contact the ground during use.

Midsole 1504 has an upper surface 1518 and a lower surface 1520. As shown in FIG. 15 lower surface 1520 of midsole 1504 has concave indentations 1522 formed therein. Concave indentations 1522 are formed to receive resilient insert 102. In one embodiment, midsole 1504 does not have side edges, and is made from EVA foam, as is conventional in the art.

Figure 16:
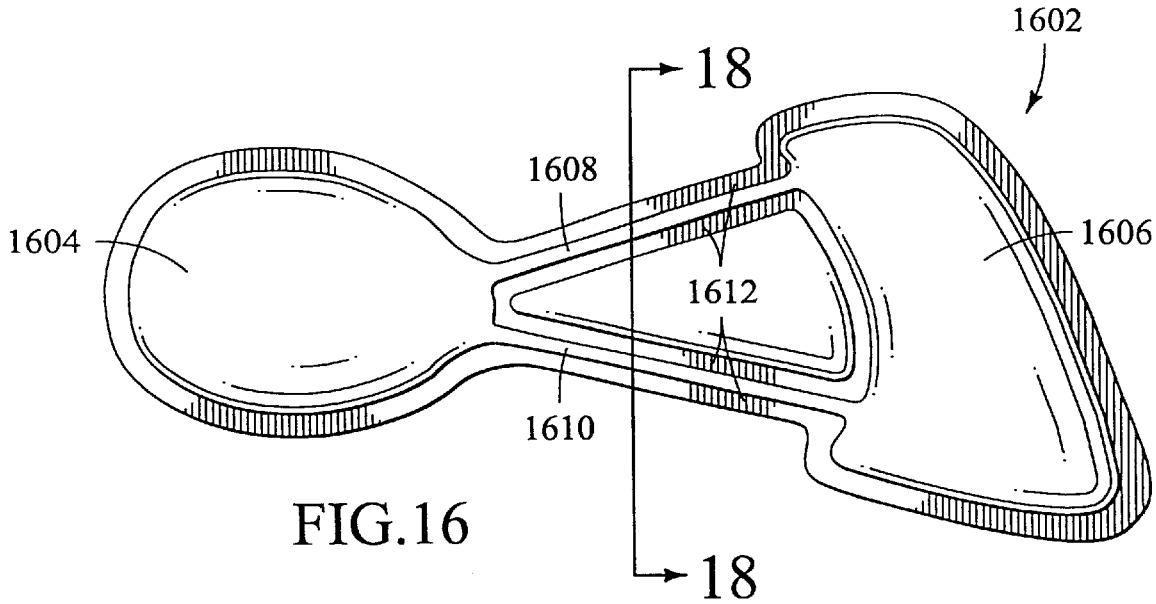
FIG. 16 is a top plan view of a bladder of the present invention.
Figure 17:
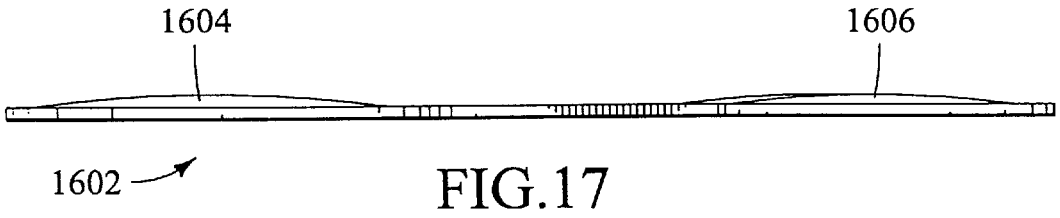
FIG. 17 is a medial side view of the bladder of FIG. 16.
Figure 18:
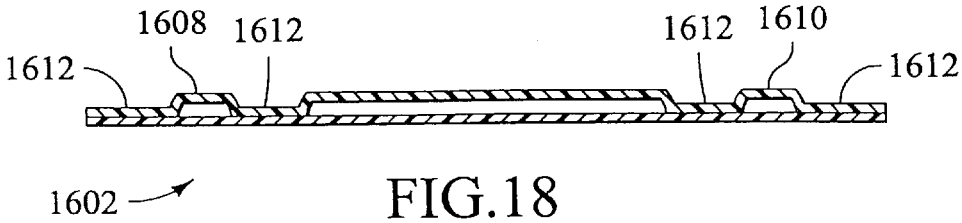
FIG. 18 is a cross-sectional view taken along line 18—18 of FIG. 16.

FIGS. 16–18 show a bladder 1602 of the present invention. Bladder 1602 has a rear air chamber 1604 and a front air chamber 1606. In one embodiment, bladder 1602 is manufactured by thermoforming two sheets of plastic film. Each sheet of film used in the thermoforming process is between approximately 6–25 mils (0.15–0.60 mm). In the preferred embodiment, sheets of film between 10–15 mils (0.25–0.40 mm) are preferred. FIG. 16 shows weld lines 1612 created by the thermoforming manufacturing process. Bladder 1602 is made from a relatively soft material, such as urethane film having a hardness of Shore A 80–90, so that bladder 1602 provides added cushioning to the wearer.

During the thermoforming process, weld lines 1612 form connecting passages 1608 and 1610 which fluidly connect rear and front chambers 1604 and 1606. Connecting passages 1608 and 1610 are preferably narrow, approximately 0.030 inch (0.8 mm)–0.050 inch (1.3 mm) in width and 0.030 inch (0.8 mm)–0.050 inch (1.3 mm) in height, to control the rate of air flow between rear air chamber 1604 and front air chamber 1606 during use. In another embodiment, bladder 1602 may be formed by RF welding, heat welding or ultrasonic welding of the urethane film material, instead of thermoforming.

Bladder 1602 is a hollow structure preferably filled with air at slightly above ambient pressure (e.g., at 1–5 psi above ambient pressure). In one embodiment, bladder 1602 is impermeable to air; i.e., hermetically sealed, such that it is not possible for the air disposed therein to escape upon application of force to bladder 1602. Naturally, diffusion may occur in and out of bladder 1602. However, because bladder 1602 contains air at only slightly above ambient pressure, it retains its cushioning properties throughout the life of the article of footwear in which it is incorporated.

FIG. 17 shows a medial side view of bladder 1602. FIG. 18 shows a cross-sectional view of bladder 1602 taken along line 18—18 of FIG. 16. In particular, FIG. 18 shows connecting passages 1608 and 1610 formed by weld lines 1612. As shown in FIGS. 17 and 18, the portion of bladder 1602 disposed between connecting passages 1608 and 1610, is relatively flat. Thus, bladder 1602 provides cushioning for the heel and forefoot portions of the wearer's feet.

Figures 19, 20:
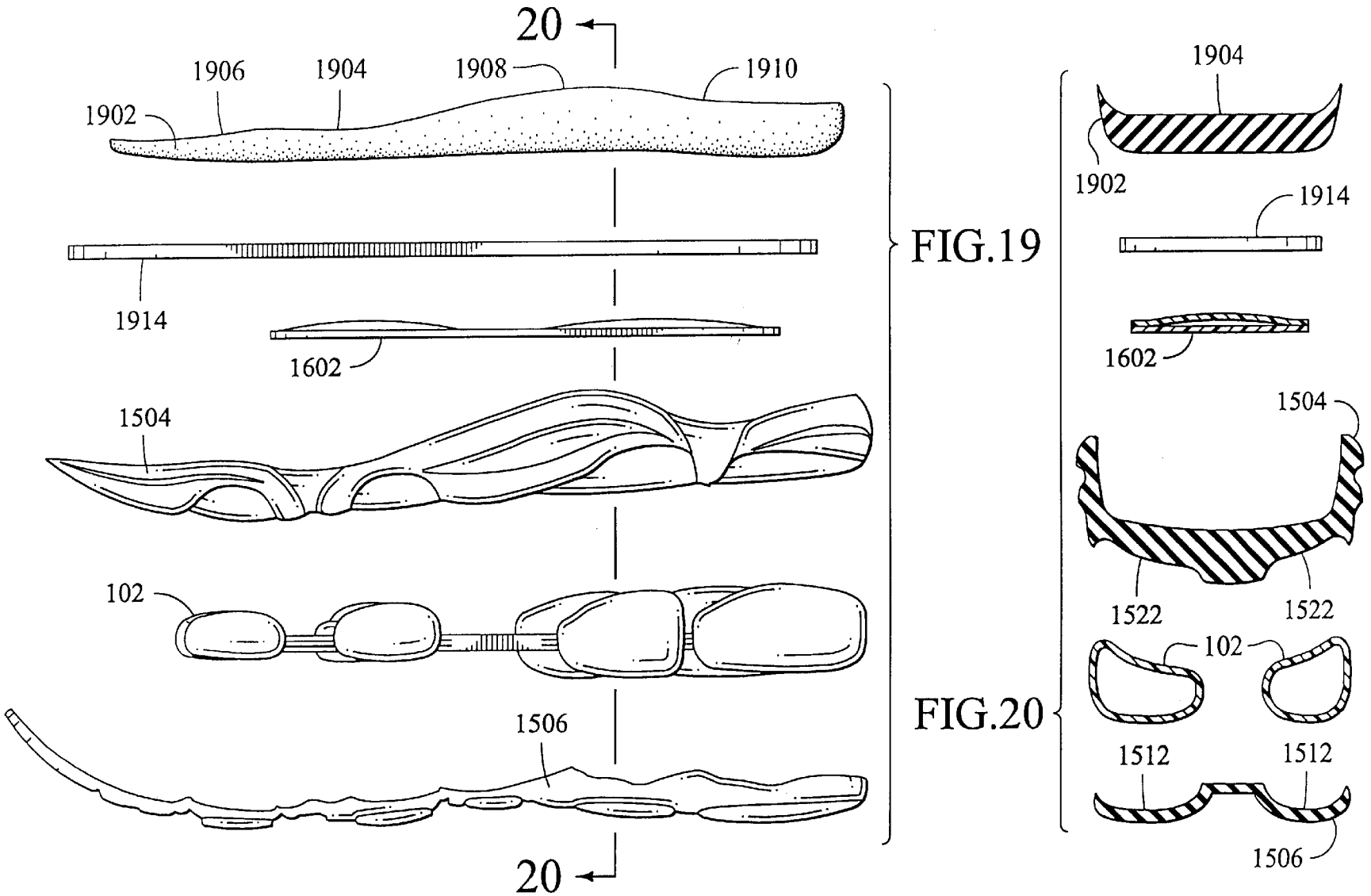
FIG. 19 is an exploded view of an exemplary configuration of the outsole, resilient insert, midsole and bladder in accordance with the present invention.
FIG. 20 is a cross-sectional view taken along line 20—20 of FIG. 19.

In order to appreciate the manner in which resilient insert 102 and bladder 1602 may cooperate to provide both support and cushioning within a shoe, FIG. 19 discloses an exemplary configuration of incorporation of these members within an article of footwear. FIG. 19 is an exploded view showing sockliner 1902, lasting board 1914, bladder 1602, midsole 1504, resilient insert 102 and outsole 1506 as disposed within an article of footwear. FIG. 20 is a cross-sectional view taken along line 20—20 of FIG. 19. Thus, in the embodiment shown in FIG. 19, resilient insert 102 is shown disposed between outsole 1506 and midsole 1504. FIG. 20 shows the indentations 1512, 1522 formed in outsole 1506 and midsole 1504, respectively to accommodate resilient insert 102, as described above.

Bladder 1602 is shown disposed above midsole 1504 and below a lasting board 1914 and a sockliner 1902. Lasting board 1914 may be made from a thick paper material, fibers or textiles, and is disposed between sockliner 1902 and bladder 1602. Sockliner 1902 includes a foot supporting surface 1904 having a forefoot region 1906, an arch support region 1908 and a heel region 1910. A peripheral wall 1912 extends upwardly from and surrounds a portion of foot supporting surface 1904.

Figure 21:
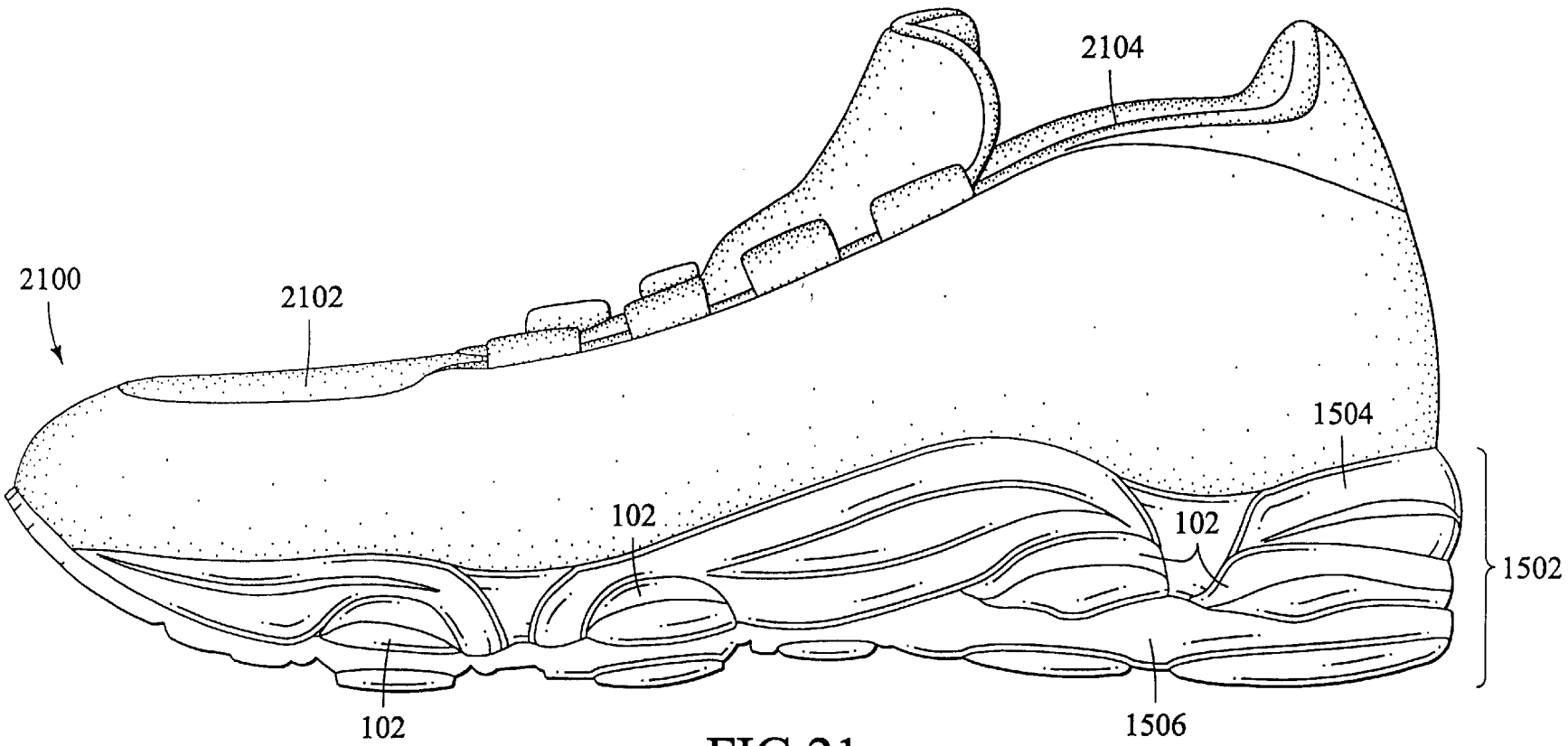
FIG. 21 is a perspective view of a shoe of the present invention.

An article of footwear incorporating the present invention is now described with reference to FIG. 21. Resilient insert 102 and bladder 1602 are disposed within an article of footwear 2100, shown in FIG. 21. Article of footwear 2100 includes a sole 1502 including outsole 1506 and midsole 1504. Resilient insert 102 is disposed between outsole 1506 and midsole 1504. Resilient insert 102 is visible in FIG. 21. In another embodiment, outsole 1506 is made so that portions of the outer edges of the heel and forefoot chambers of resilient insert 102 are visible. Further, bladder 1602 (not visible in FIG. 21) is disposed between midsole 1504 and lasting board 1902 (not visible in FIG. 21). An upper 2102 is attached to sole 1502. Upper 2102 has an interior portion 2104. The insole is disposed in interior portion 2104.

In order to fully appreciate the cushioning effect of the present invention, the operation of the present invention will now be described in detail. When stationary, the foot of a wearer is cushioned by bladder 1602. Although the maximum thickness of bladder 1602, is approximately 0.2 inch (5 mm) above the top surface of midsole 1504, the bladder produces an unexpectedly high cushioning effect. In one embodiment, bladder 1602, made by RF welding, is between 0.08–0.12 inch (2–3 mm). If bladder 1602 is blow molded, it may be as thick as 0.28–0.31 inch (7–8 mm) when manufactured, and can be partially recessed in midsole 1504.

When the wearer begins a stride, the heel of the wearer's foot typically impacts the ground first. At this time, the weight of the wearer applies downward pressure on heel portion 106 of resilient insert 102, causing heel chambers 116, 118, 120 and 122 of heel portion 106 to be forced downwardly while their concave upper surfaces are simultaneously inflated about the wearer's heel. Further, large lateral heel chamber 118 absorbs the main impact of the heel strike due to its size and location within the insert. After heel strike and before toe-off, the heel of the wearer also experiences a shear force that occurs when the heel of the wearer briefly moves forwardly while the heel portion of the shoe sole remains in contact with the surface. The decoupled portion 1204 of heel chamber 118 is shaped so that it flexes forward when the wearer's heel briefly moves forwardly while the heel portion of the shoe sole remains in contact with the surface and then flexes back when the heel portion of the shoe sole is lifted off the surface during toe-off.

The configuration of heel chamber interconnection passages 128 between heel chambers 116, 118, 120 and 122 can help compensate for the problem of over-pronation, the natural tendency of the foot to roll inwardly after heel impact. During a typical gait cycle, the main distribution of forces on the foot begins adjacent the lateral side of the heel during the "heel strike" phase of the gait, then moves toward the center axis of the foot in the arch area, at which point the wearer's heel experiences the shear force due to the forward momentum of the heel while in contact with the surface, and finally moves to the medial side of the forefoot area during "toe-off." The configuration of heel chambers 116, 118, 120 and 122 is incorporated within resilient insert 102 to ensure that the air flow within resilient insert 102 complements such a gait cycle.

Referring to FIG. 1, it has been previously noted that the rearmost heel chamber interconnection passage 128 within heel portion 106 essentially divides heel portion 106 into two regions: medial region 130 and lateral region 132. The downward pressure resulting from heel strike causes air within resilient insert 102 to flow from medial region 130, including heel chambers 120 and 122, into lateral region 132, including heel chambers 116, and 118. Thus, medial region 130, is cushioned first to prevent the wearer's foot from rolling inwardly. Further compression of heel portion 106 causes the air in lateral region 132 to be forced forwardly, through central connecting passage 124, into forefoot portion 104.

The velocity at which the air flows between heel chambers 116, 118, 120 and 122 and forefoot chambers 108, 110, 112 and 114 depends on the structure of central connecting passage 124 and, in particular, the structure of impedance means 126.

The flow of air into forefoot portion 104 causes forefoot chambers 108, 110, 112 and 114 to expand, which slightly raises the forefoot or metatarsal area of the foot. It should be noted that when forefoot chambers 108, 110, 112 and 114 expand, they assume a somewhat convex shape inflating about the foot of the wearer. When the forefoot of the wearer is placed upon the ground, the expanded forefoot chambers 108, 110, 112 and 114 help cushion the corresponding impact forces. The longitudinal arrangement of forefoot chambers 108, 110, 112 and 114 is such that lines A—A, B—B, C—C and D—D which extend respectively therethrough are essentially perpendicular to the longitudinal center axis X—X of insert 102. This arrangement of the forefoot chambers allows for greater flexibility about the metatarsal region of the insert during toe-off. As the weight of the wearer is applied to the forefoot during toe-off, the downward pressure due to the impact forces a portion of forefoot chambers 108, 110, 112 and 114 about axis X—X of the insert to compress, forcing air within the chambers to inflate concave portions 702, 802, 902 and 1002 to cradle the foot and to provide increased stability. In addition, air is simultaneously forced rearwardly through connecting passage 124 into heel portion 106. Once again, the velocity at which the air flows from forefoot chambers 108,110, 112 and 114 to heel chambers 116, 118, 120 and 122 will be determined by the structure of impedance means 126.

After "toe-off," no downward pressure is being applied to the article of footwear, so the air within resilient insert 102 should return to its normal state. Upon the next heel strike, the process is repeated.

In light of the foregoing, it will be understood that resilient insert 102 of the present invention provides a variable, non-static cushioning, in that the flow of air within resilient insert 102 complements the natural biodynamics of an individual's gait.

Because the "heel strike" phase of a stride or gait usually causes greater impact forces than the "toe-off" phase thereof, it is anticipated that the air will flow more quickly from heel portion 106 to forefoot portion 104 than from forefoot portion 104 to heel portion 106. Similarly, impact forces are usually greater during running than walking. Therefore, it is anticipated that the air flow will be more rapid between the chambers during running than during walking.

The foregoing description of the preferred embodiment has been presented for purposes of illustration and description. It is not intended to be exhaustive or to limit the invention to the precise form disclosed, and obviously many modifications and variations are possible in light of the above teachings.

Similarly, it is not necessary that bladder 1602 be shaped as shown in FIG. 16. For example, FIGS. 16–18 of U.S. Pat. No. 5,771,606 to Litchfield et al., incorporated herein by reference, shows alternate embodiments of the bladder of the present invention which are equally acceptable.

Although an oval-shaped impedance means is shown in the accompanying drawings, other shapes will also serve to provide support and cushioning to resilient insert 102 of the present invention. The shape of impedance means 126 will directly affect the velocity of the air as it travels within resilient insert 102.

The mass flowrate of air within the resilient insert of the present invention is dependent upon the velocity of the heel strike (in the case of air traveling from the heel chamber to the forefoot chamber). Further, the size and structure of the impedance means of the present invention directly affects the impulse forces exerted by the air moving within the chambers of the resilient insert. With a given flowrate, the size and structure of the impedance means will dramatically affect the velocity of the air as it travels through the impedance means. Specifically, as the cross-sectional area of the impedance means becomes smaller, the velocity of the air flow becomes greater, as do the impulse forces felt in the forefoot and heel chambers.

It is anticipated that the preferred embodiment of resilient insert 102 of the present invention will find its greatest utility in athletic shoes (i.e., those designed for walking, hiking, running, and other athletic activities).

While the invention has been particularly shown and described with reference to preferred embodiments thereof, it will be understood by those skilled in the art that various changes in form and details may be made therein without departing from the spirit and scope of the invention.

What is claimed is:

1. An article of footwear comprising:

a sole; and a resilient insert disposed within said sole, said resilient insert including a first portion with a plurality of first compressible chambers fluidly interconnected to each other, wherein at least one chamber of said plurality of first chambers has a medial side, a lateral side and a substantially concave upper surface extending from said medial side to said lateral side in both an uncompressed state and a compressed state.

2. The article of footwear of claim 1, wherein said resilient insert contains air at ambient pressure in an uncompressed state.

3. The article of footwear of claim 1, wherein said resilient insert contains air at slightly above ambient pressure in an uncompressed state.

4. The article of footwear of claim 1, wherein said resilient insert further comprises:

a second portion with a plurality of second compressible chambers fluidly interconnected to each other;

a connecting passage fluidly interconnecting only one chamber of said first portion with only one chamber of said second portion; and impedance means, disposed within said connecting passage, for restricting a flow of air between said first portion and said second portion, wherein a cross-sectional area of said connecting passage, taken at a point at which said impedance means is disposed, has an average cross-sectional area less than the remainder of said connecting passage.

5. The article of footwear of claim 4, wherein said sole further comprises an outsole and a midsole, and wherein said resilient insert is disposed between said outsole and said midsole.

6. The article of footwear of claim 5, wherein said outsole further comprises an upper surface and a lower surface, said upper surface of said outsole having a plurality of corresponding indentations therein for receiving said plurality of first and second chambers of said resilient insert.

7. The article of footwear of claim 5, wherein said midsole further comprises an upper surface and a lower surface, said lower surface of said midsole having a plurality of corresponding indentations therein for receiving said plurality of first and second chambers of said resilient insert.

8. The article of footwear of claim 1, wherein said resilient insert is formed of a blow-molded elastomeric material.

9. The article of footwear in claim 1, wherein said resilient insert is vacuum formed.

10. The article of footwear in claim 1, wherein said resilient insert is thermoformed.

11. The article of footwear of claim 1, wherein at least one chamber of said plurality of first chambers is substantially larger than other of said plurality of first chambers.

12. The article of footwear of claim 1, wherein said plurality of first chambers are arranged so that a line taken lengthwise through each of said first chambers is essentially perpendicular to a longitudinal centerline of the resilient insert.

13. The article of footwear of claim 1, wherein at least one chamber of said plurality of first chambers is a decoupled portion of said resilient insert.

14. A resilient insert for an article of footwear comprising:

a plurality of compressible chambers containing air at ambient pressure, said plurality of chambers fluidly interconnected to each other, wherein at least one chamber of said plurality of chambers has a substantially concave upper surface that extends to an uppermost point at a lateral edge of said at least one chamber in both an uncompressed state and a compressed state.

15. The resilient insert of claim 14, further comprising impedance means disposed within said connecting passage, wherein said impedance means restricts a flow of air between said plurality of heel chambers and said plurality of forefoot chambers and provides enhanced support and cushioning to the article of footwear by controlling the velocity at which the air moves between said plurality of heel chambers and said plurality of forefoot chambers.

16. The resilient insert of claim 14, wherein said resilient insert is formed of a unitary piece of blow-molded elastomeric material.

17. The resilient insert of claim 14, wherein at least one chamber of said plurality of heel chambers is substantially larger than other of said plurality of heel chambers.

18. The resilient insert of claim 14, wherein said plurality of forefoot chambers are arranged so that a line taken lengthwise through each of said forefoot chambers is essentially perpendicular to a longitudinal centerline of the resilient insert.

19. The resilient insert of claim 14, wherein at least one chamber of said plurality of heel chambers has a decoupled portion.

20. An article of footwear comprising:

a sole;

a resilient insert disposed within said sole, said resilient insert including a plurality of compressible chambers fluidly interconnected to each other, wherein at least one chamber of said plurality of chambers includes an upper surface having a medial side and a lateral side, said upper surface being substantially flat on said medial side of said upper surface, and said upper surface being substantially concave on said lateral side of said upper surface in both an uncompressed state and a compressed state.

21. The article of footwear of claim 20, said sole including a heel portion and a forefoot portion, wherein said plurality of chambers are disposed in said heel portion of said sole.

22. The article of footwear of claim 20, wherein said plurality of chambers includes at least one lateral heel chamber.

23. The article of footwear of claim 22, wherein said at least one lateral heel chamber includes an upper surface having a medial side and a lateral side, said upper surface being substantially flat on said medial side of said upper surface, and said upper surface being substantially concave on said lateral side of said upper surface in both an uncompressed state and a compressed state.

24. The article of footwear of claim 22, wherein said at least one lateral heel chamber is a decoupled portion of said resilient insert.

25. The article of footwear of claim 23, wherein said plurality of chambers includes at least one medial heel chamber.

26. The article of footwear of claim 25, wherein said at least one medial heel chamber has a substantially concave upper surface extending upwards from an outer edge of said medial heel chamber in both an uncompressed state and a compressed state, whereby said at least one medial heel chamber and said at least one lateral heel chamber form a substantially concave cushioning area for a wearer's heel.

27. The article of footwear of claim 25, wherein said at least one medial heel chamber includes an upper surface having a medial side and a lateral side, said upper surface being substantially flat on said lateral side of said upper surface, and said upper surface being substantially concave on said medial side of said upper surface in both an uncompressed state and a compressed state, whereby said at least one medial heel chamber and said at least one lateral heel chamber form a substantially concave cushioning area for a wearer's heel.

28. The article of footwear of claim 20, wherein said resilient insert contains air at ambient pressure in an uncompressed state.

29. The article of footwear of claim 20, wherein said plurality of chambers are connected in series.

30. The article of footwear of claim 20, wherein said resilient insert contains air at slightly above ambient pressure in an uncompressed state.

31. The article of footwear of claim 20, wherein said sole further comprises an outsole and a midsole, and wherein said resilient insert is disposed between said outsole and said midsole.

32. The article of footwear of claim 31, wherein said outsole further comprises an upper surface and a lower surface, said upper surface of said outsole having a plurality of corresponding indentations therein for receiving said plurality of chambers of said resilient insert.

33. The article of footwear of claim 31, wherein said midsole further comprises an upper surface and a lower surface, said lower surface of said midsole having a plurality of corresponding indentations therein for receiving said plurality of chambers of said resilient insert.

34. The article of footwear of claim 20, wherein at least one chamber of said plurality of chambers is substantially larger than another of said plurality of chambers.

* * * * *